United States Patent [19]

Outten

[11] 4,090,895

[45] May 23, 1978

[54] HIGH ENERGY FUEL SLURRY

[75] Inventor: Edward Outten, Rockaway, N.J.

[73] Assignee: Thiokol Corporation, Newtown, Pa.

[21] Appl. No.: 520,835

[22] Filed: Jan. 13, 1966

[51] Int. Cl.[2] ..... C06B 43/00

[52] U.S. Cl. ..... 149/22; 60/216; 149/1; 149/108.2; 149/114; 149/118

[58] Field of Search ..... 60/216; 149/87, 22, 149/108.2, 118

[56] References Cited

U.S. PATENT DOCUMENTS

| | | | |
|---|---|---|---|
| 2,771,739 | 11/1956 | Malina et al. | 60/216 |
| 2,994,191 | 8/1961 | Hamilton | 149/87 X |
| 3,116,187 | 12/1963 | Scanlon et al. | 149/36 X |
| 3,197,348 | 7/1965 | Skolnik et al. | 149/36 X |
| 3,221,494 | 12/1965 | Chu | 149/36 X |
| 3,857,743 | 12/1974 | Allan | 149/118 X |

*Primary Examiner*—Leland A. Sebastian

*Attorney, Agent, or Firm*—Stanley A. Marcus; William R. Wright, Jr.

[57] ABSTRACT

A fuel for rocket motors is provided in the form of a slurry of particulate metal or metalloid particles having a particle size of about 0.1 to 10 microns suspended in an alcohol having from 1 to 3 carbon atoms in the presence of a non-thixotropic amount of high viscosity grade hydroxypropyl cellulose.

8 Claims, No Drawings

HIGH ENERGY FUEL SLURRY

This invention relates to rocket propellants. More particularly, this invention relates to high energy fuels for packaged liquid propellant systems and to a method of utilizing these fuels.

Air launched missiles have proved to be effective weapon systems for destroying both air and ground targets. The requirements of such missiles can best be realized by the use of packaged liquid propellants, i.e., propellants which can be hermetically sealed within the storage tanks of a missile and which, after being held in such tanks for extended periods of time under extreme environmental conditions, can be successfully and reliably ignited and burned to propel the missile to its target. However, fuels and oxidizers for packaged liquid propellant systems must satisfy many stringent requirements, some of which have not been completely met by the fuels and oxidizers employed heretofore. For example, the fuel and oxidizer for a packaged liquid propellant system of an air-to-air or air-to-ground missile should provide, in order to fulfill the need for higher missile velocities under conditions of modern aerial warfare, a delivered specific impulse and density impulse of at least 240 seconds and 415 gm-sec/cc respectively under conditions of 1000 psi chamber pressure exhausted to 14.7 psi, which values are difficult to attain by means of liquid fuels containing no high energy additives. Also both the fuel and oxidizer of a packaged liquid propellant system should be storable for periods of up to 10 years, under temperatures as low as −65° F. and as high as 160° F., without undergoing extensive deterioration or corroding the containers in which they are held. However, it has been found that when high energy additives such as powdered boron are added to certain liquid fuels (e.g., mixtures of hydrazine, monomethylhydrazine and hydrazine nitrate), the fuels evolve gas at a rate that is unacceptable from the standpoint of their long term storage in propellant tanks of missiles. Among the many additional properties which are desirable for packaged liquid fuels and oxidizers are low shock sensitivity, low viscosity, low freezing point, high boiling point, high autoignition point, and nontoxicity. Where a powdered material such as boron is added to a liquid fuel to increase its energy, it is also necessary that the additive does not settle from suspension to any great extent when the mixture is subjected to long storage, either under conditions of quiescence or vibration, or is subjected to high gravitational forces such as those encountered in the operation of high-speed aircraft. In addition, any gelling agent added to such as fuel-additive mixture to maintain the solid component in suspension must not produce undesirable side effects, such as for example, formation of a fuel-additive mixture that has poor flow characteristics because of the inclusion of cohesive clumps of material therein. Furthermore, to eliminate the need for a complicated ignition system in an air launched missile, it is advantageous to utilize hypergolic fuels and oxidizers in packaged liquid propellant systems. Thus the problem of providing a suitable fuel-oxidizer combination for a liquid propellant missile of the type described is not easy to solve, particularly where the fuel contains a powdered metal or metalliod to increase its energy.

It is accordingly a broad object of this invention to provide an improved packaged liquid propellant system.

Another object of this invention is to provide a high energy fuel for use with a hypergolic oxidizer in a packaged liquid propellant system.

An additional object of this invention is to provide a stable fuel slurry comprising a finely divided solid interspersed in a liquid fuel.

Still another object of this invention is to provide a method of propelling a rocket by means of a high energy fuel slurry and an oxidizer that reacts spontaneously therewith.

In accordance with this invention the above and other objects are accomplished by a propellant system which utilizes as a fuel a mixture of a finely divided metal or metalliod and an alcohol selected from the group consisting of methanol, ethanol, 1-propanol and 2-propanol, and which utilizes as an oxidizer a halogen or an interhalogen that reacts hypergolically with said fuel mixture. The named alcohols are advantageous as liquid carriers for high energy solid additives primarily because of their low freezing points and because the oxygen they contain helps to oxidize some or all of their carbon to carbon monoxide during burning with a halogen containing oxidizer. Furthermore, they are readily available and have low cost, low toxicity and high stability to thermal degradation. Particularly preferred as a fuel for a packaged liquid propellant is a mixture of methanol and powdered boron which is hypergolically reactive with a halogen such as fluorine, and with interhalogens such as chlorine trifluoride and chlorine pentafluoride, to thereby provide a high density impulse propellant system. Moreover, this fuel mixture has been found to possess good storage characteristics and to be insensitive to shock.

The addition of a high energy solid additive to the fuel component of a packaged liquid propellant system raises the density impulse of the system significantly while the specific impulse is only slightly lowered. This trend continues until the fuel component comprises nothing but solid additive. At this point the highest theoretical energy can be achieved from the propellant system. Obviously, however, a fuel consisting only of solid additive cannot be flowed or considered for use in a liquid propellant rocket engine. However, it is desirable to use as much solid additive as possible and the maximum is limited by the flow properties of the resulting fuel slurry.

Also, because of practical considerations in the design of valves, injectors, etc. of the fluid flow system of a liquid propellant rocket motor and because of the problem of maintaining a high energy solid additive in suspension in a liquid fuel, the ratio of solid to liquid fuel that produces a useful fuel slurry for a packaged liquid propellant system is critical. The particle size of the solid is also of importance. The viscosity of a slurry is higher when it contains higher amounts of solid additive or solid additives of a smaller particle size. Higher viscosity is reflected in higher pressure drops in fuel lines and injectors for which maximums have been set. Therefore when solid additives with particle sizes of 5-10 microns are used, concentrations of up to about 80 weight percent may possibly be used before the slurry becomes too thick whereas when particle sizes are in the submicron range, solids may be added only to about 40 weight percent before the slurry becomes too thick.

Since higher solid additive concentrations are desirable from an energy viewpoint, a large (5-10 micron) particle size additive should be used to achieve higher solids. This cannot always be done because it is more difficult to efficiently burn larger particles in the rocket engine. Thus a balance must be found in each instance between the particle size which will produce lower viscosities and the particle size which will burn efficiently.

It has been found that boron, aluminum, titanium, zirconium, aluminum boride, titanium boride and zirconium boride form free-flowing fuel slurries when divided to a particle size in the range of from about 0.1 micron to about 10 microns and intimately mixed (as will be described hereinafter) with one of the above-named alcohols to form liquid fuel-solid additive mixtures containing from 40 to 80 percent by weight of solid and 0 to 2 percent by weight of gellant. These slurries also exhibit a low tendency to settle from suspension even after long storage. A preferred fuel slurry that has been found to have excellent flow and suspension properties is a mixture comprising 50 parts by weight of particulate boron having a particle size of from 1 to 2 microns, 49 parts by weight of methanol, and 1 part by weight of hydroxypropyl cellulose as a gellant.

This invention is illustrated by the following examples.

EXAMPLE 1

A mixture of 49 parts by weight of methanol of a purity of 99.85 percent, 50 parts by weight of amorphous boron with a 1–2 micron particle size and 1 part by weight of high viscosity grade hydroxypropyl cellulose gellant is prepared in the following manner. The gellant is intimately mixed with the boron and this mixture is added to methanol using a low shear mixer such as a dough mixer to blend in the solids. Low shear mixing is continued until the slurry is homogeneous (~30 minutes) and only slightly granular. The slurry is then subjected to a short period (1–2 minutes) of high shear mixing such as can be accomplished with a saw-toothed disc with a tip speed of approximately 3,000–6,000 ft/sec. This breaks up the small aggregates of boron and produces a smooth slurry in which no particles can be seen. All mixing is conducted at ambient temperature and pressure and in closed vessels due to the high evaporation rate of methanol.

The fuel slurry thus formed has a viscosity of 15 poise at a shear rate of 100 $sec^{-1}$, 4 poise at a shear rate of 1000 $sec^{-1}$ and 1 poise at a shear rate of 10,000 $sec^{-1}$, as determined at 25° C using a Ferranti Shirley cone and plate viscometer. Thus it is readily injected by conventional means into the combustion chamber of a rocket motor. Chlorine trifluoride simultaneously injected into the combustion chamber of a rocket motor with the described fuel slurry reacts with it upon contact, producing a specific impulse of 252 sec and a density impulse of 420 g sec/cc when the oxidizer and fuel in the slurry are in the ratio of 6 to 1. All impulse figures given herein are for 1000 psi chamber pressure exhausted to 14.7 psi. Other halogens and interhalogens, such as $F_2$, CIF, $CIF_5$, $BrF_3$ and $BrF_5$ also react hypergolically with the fuel slurry.

The safety of the aforementioned fuel slurry was tested using the JANAF card gap test. At a gap of zero cards, no evidence of detonation was observed in duplicate tests.

The fuel slurry produces a pressure rise of less than 0.006 psi/day when stored at 160° F in tanks with 5 percent vapor space. This is equivalent to a decomposition rate of less than $10^{-8}$ moles of gas per gram of slurry per day and is well within the limit specified for a packaged propellant. The fuel slurry when subjected to vibration of 10 to 36 cycles per second for 32 hours under a 9 g maximum acceleration undergoes a very minimum amount of settling of the solid additive (less than 5 percent) which is within the acceptable limits for a packaged slurry propellant.

EXAMPLE 2

A fuel slurry containing 49 parts by weight of ethanol with a minimum purity of 99 percent, 50 parts by weight of amorphous boron with a particle size of 1-2 microns and 1 part by weight of high viscosity grade hydroxypropyl cellulose gellant is formed by the same steps described in Example 1.

The fuel slurry thus formed has a viscosity of 20 poise at a shear rate of 100 $sec^{-1}$, 4 poise at a shear rate of 1000 $sec^{-1}$ and 1 poise at a shear rate of 10,000 $sec^{-1}$, as determined at 25° C using a Ferranti Shirley cone and plate viscometer. Thus it is readily injected by conventional means into the combustion chamber of a rocket motor. Chlorine pentafluoride simultaneously injected into the combustion chamber of a rocket motor with the described fuel slurry reacts with it upon contact, producing a specific impulse of 260 sec and a density impulse of 430 g sec/cc when the oxidizer and fuel in the slurry are in the ratio of 5.5 to 1.

The safety, thermal stability and resistance to settling of this slurry are the same as that of Example 1.

EXAMPLE 3

A fuel slurry containing 49 parts by weight of 1-propanol with a minimum purity of 99 percent, 50 parts by weight of amorphous boron with a particle size of 1–2 microns and 1 part by weight of high viscosity grade hydroxypropyl cellulose gellant is formed by the same steps described in Example 1.

The properties of this fuel slurry are essentially the same as that of Example 2 with the exception that its performance in a rocket engine is slightly lower than in Example 2 due to the lower percentage of oxygen in the propanol molecule. Chlorine pentafluoride simultaneously injected into the combustion chamber of a rocket motor with the described fuel slurry reacts with it upon contact, producing a specific impulse of 258 sec and a density impulse of 426 g sec/cc when the oxidizer and fuel slurry are in the ratio of 5.5 to 1.

EXAMPLE 4

A fuel slurry formed of 2-propanol and boron is prepared by the same process steps described in the proceeding example, the parts by weight and purity of the constituents being as stated therein.

The fuel slurry thus formed has substantially the same properties as the 1-propanol and boron fuel slurry described in Example 3 and, when contacted with chlorine trifluoride in the combustion chamber of a rocket motor, reacts hypergolically with this oxidizer to produce a specific impulse of 249 sec and a density impulse of 415 g sec/cc when the oxidizer and fuel in the slurry are in the ratio of 6.2 to 1.

EXAMPLE 5

A fuel slurry containing 24 parts by weight of methanol with a purity of 99.85 percent 75 parts by weight of spherical aluminum powder with a particle size of 5 microns and 1 part by weight of high viscosity grade hydroxypropyl cellulose is formed by the same steps described in Example 1.

The fuel slurry thus formed has a viscosity of 100 poise at a shear rate of 100 $sec^{-1}$, 16 poise at a shear rate of 1000 $sec^{-1}$ and 1 poise at a shear rate of 10,000 $sec^{-1}$ as determined at 25° C using a Ferranti Shirley cone and plate viscometer. Thus it is readily injected by conventional means into the combustion chamber of a rocket motor. Chlorine trifluoride simultaneously injected into the combustion chamber of a rocket motor with the described fuel slurry reacts with it upon contact, producing a specific impulse of 240 sec and a density impulse of 426 g sec/cc when the oxidizer and fuel in the slurry are in the ratio of 3.0 to 1.

The safety, thermal stability and resistance to settling of this slurry are the same as that of Example 1.

EXAMPLE 6

A fuel slurry consisting of 39 parts by weight of ethanol with a minimum purity of 99 percent, 60 parts by weight of zirconium with a particle size of 2-10 microns and 1 part by weight of high viscosity grade hydroxypropyl cellulose gellant is formed by the same steps described in Example 1.

The fuel slurry thus formed has a viscosity of 70 poise at a shear rate of 100 $sec^{-1}$, 12 poise at a shear rate of 1000 $sec^{-1}$ and 1 poise at a shear rate of 10,000 $sec^{-1}$ as determined at 25° C using a Ferranti Shirley cone and plate viscometer. Thus it is readily injected by conventional means into the combustion chamber of a rocket motor. Chlorine pentafluoride simultaneously injected into the combustion chamber with the described fuel slurry reacts with it hypergolically, producing a specific impulse of 245 sec and a density impulse of 428 g sec/cc, when the oxidizer and fuel in the slurry are in the ratio of 1.8 to 1. The safety, thermal stability and resistance to settling of this slurry are the same as that of Example 1.

EXAMPLE 7

A fuel slurrly consisting of 39 parts by weight of 1-propanol with a minimum purity of 99 percent, 60 parts by weight of $ZrB_2$ with a particle size of 3-5 microns and 1 part by weight of high viscosity grade hydroxypropyl cellulose if formed by the same steps described in Example 1.

The fuel slurry thus formed has a viscosity of 100 poise at a shear rate of 100 $sec^{-1}$, 15 poise at a shear rate of 1000 $sec^{-1}$ and 1.5 poise at a shear rate 10,000 $sec^{-1}$ as determined at 25° C using a Ferranti Shirley cone and plate viscometer. Thus it is readily injected by conventional means into the combustion chamber of a rocket motor. Chlorine pentafluoride simultaneously injected into the combustion chamber with the described fuel slurry reacts with it upon contact, producing a specific impulse of 243 sec and a density impulse of 423 g sec/cc when the oxidizer and fuel in the slurry are in the ratio of 2.4 to 1.

The safety, thermal stability and resistance to settling are the same as that of Example 1.

In any of the fuel slurries disclosed in Examples 1 through 7, the solid additive employed therein can be replaced with one of the metals or metalloids of the following group: boron, aluminum, titanium, zirconium, aluminum boride, titanium boride and zirconium boride. Two or more of these metals and metalloids can also be mixed with methanol, ethanol, 1-propanol and 2-propanol to form fuel slurries with superior properties for packaged liquid propellant systems. Preferably the ratio of solid to alcohol in each of these fuel slurries is stoichiometric.

The oxidizers that are hypergolically reactive with the above-described fuel slurries are not limited to those specified in Example 1 through 7. Each of the fuel slurries formed of a solid selected from the named metals and metalloids of a methyl, ethyl or propyl alcohol reacts hypergolically with, among other oxidizers, $F_2$, ClF, $ClF_3$, $ClF_5$, $BrF_3$ and $BrF_5$. Preferably the fuel slurry and oxidizer selected for a particular packaged liquid propellant system are injected into the combustion chamber of a rocket motor in stoichiometric ratio.

What is claimed is:

1. A fuel for rocket motors consisting essentially of a slurry of a high energy solid additive in non-settling suspension in a liquid fuel, said slurry comprising finely divided solids having a particle size of less than about 10 microns selected from the group consisting of boron, aluminum, aluminum boride, titanium boride, zirconium boride and mixtures thereof, and a liquid fuel selected from the group consisting of methanol, 1-ethanol, 1-propanol and 2-propanol, and mixtures thereof, said solids being suspended in said liquid in an amount less than about 80 percent by weight of the slurry in the presence of less than a thixotropic amount of a high viscosity grade of hydroxypropyl cellulose, and said fuel having a gas evolution rate within standard test limits for a packaged propellant when the fuel slurry is stored in a tank at 160° F. with 5% vapor space.

2. A fuel as defined in claim 1 wherein said solid is boron.

3. A fuel as defined in Claim 1 wherein said solid is boron and said liquid fuel is methanol.

4. A fuel as defined in claim 1 wherein said solid is boron and said liquid fuel is ethanol.

5. A fuel as defined in claim 1 wherein said solid is boron and said liquid fuel is 1-propanol.

6. A fuel as defined in claim 1 wherein said solid is boron and said liquid fuel is 2-propanol.

7. A fuel as defined in claim 1 containing from 40 to 80 percent by weight of solid.

8. A fuel as defined in claim 1 wherein said solid has a particle size in the range of from about 0.1 micron to about 10 microns.

* * * * *